United States Patent [19]

Gurcan et al.

[11] Patent Number: 4,800,349

[45] Date of Patent: Jan. 24, 1989

[54] E-PLANE TYPE WIDE BAND COMPOSITE FILTER

[75] Inventors: Mustafa Gurcan, Osny; Jean-Claude Cruchon, Bouffemont, both of France

[73] Assignee: Alcatel Thomson Faisceaux, Cedex, France

[21] Appl. No.: 97,989

[22] Filed: Sep. 17, 1987

[30] Foreign Application Priority Data

Sep. 18, 1986 [FR] France ..... 86 13083

[51] Int. Cl.[4] ..... H01P 1/207; H01P 5/02

[52] U.S. Cl. ..... 333/208; 333/33; 333/202; 333/248

[58] Field of Search ..... 333/33, 34, 208, 209, 333/210, 211, 212, 239, 245, 246, 248, 252, 109, 202

[56] References Cited

U.S. PATENT DOCUMENTS

| | | | |
|---|---|---|---|
| 2,588,262 | 3/1952 | Matare | 178/44 |
| 3,914,713 | 10/1975 | Konishi et al. | 333/109 |
| 4,028,650 | 6/1977 | Konishi et al. | 333/210 |

FOREIGN PATENT DOCUMENTS

| | | |
|---|---|---|
| 0045242 | 2/1982 | European Pat. Off. . |
| 0145273 | 6/1985 | European Pat. Off. . |
| 0158606 | 10/1985 | European Pat. Off. . |
| 2518822 | 6/1983 | France . |

OTHER PUBLICATIONS

IEEE Transactions on Microwave Theory and Techniques, vol. MTT-33, No. 7, Jul. 1985, pp. 654-659, IEEE New York, US,; F. Arndt et al.: "E-Plane Integrated Parallel-Strip Screen Waveguide Filters".

IEEE Transactions on Microwave Theory and Techniques, vol. MTT-32, No. 1, Jan. 1984, pp. 133-135, IEEE, New York, U.S.; R. Vahldieck et al.: "W-Band Low-Insertion-Loss E-Plane Filter".

IEEE Transactions on Microwave Theory and Techniques, vol. MTT-15, No. 2, Feb. 1967, pp. 134-136, IEEE New York, U.S.; J. Reed: "Precision Design of Direct Coupled Filters".

Proceeding of the European Microwave Conference, Nuremberg, 5-8, Sep. 1983, conf. 13, pp. 168-173, Microwave Exh. & Publ. Tunbridge Wells, GB; J. Bornemann et al.: "Double Planar Integrated Millimeter-Wave Filter".

"Asymmetric Iris for a Waveguide" (Heins), 621,566, published Jun. 8, 1954, Official Gazette, vol. 683, Sep. 10, 1954, 1 page.

*Primary Examiner*—Marvin L. Nussbaum

*Attorney, Agent, or Firm*—Sughrue, Mion, Zinn, Macpeak & Seas

[57] ABSTRACT

The present invention relates to an E-plane type wide-band composite filter comprising a conductive screening body (11, 12) having an elongate cavity (14) therein with a blade cut into a ladder shape disposed longitudinally therein. Said body comprises two portions held against each other on either side of a separation plane along which said ladder (15) is disposed, with two irises (16, 17) being disposed transversely at the inlet and at the outlet of said cavity (14), each closing off a portion thereof.

7 Claims, 2 Drawing Sheets

E-PLANE TYPE WIDE BAND COMPOSITE FILTER

The invention relates to an E-plane type wide band composite filter.

BACKGROUND OF THE INVENTION

Filtering techniques are very varied. However, when frequency and/or power are high, rectangular or cylindrical waveguide filtering remains the only means for obtaining good performance with respect to loss and to selectivity.

When the relative pass band is less than about 2%, circular cavity filters have exceptional characteristics since they operate with very high Q factors.

For wider pass bands, three types of filter are currently in use:

evanescent mode or comb type filters, this low Q factor technique provides wide band filters with a Q factor $\leqq 1000$;

suspended coaxial filters, these have the same performance as the above filters with the advantage of precision due to the principle of thin layer etching; and waveguide filters.

A TE101 or "E-plane" filter is currently useable for relative passbands up to 5% or 6%. Beyond that, end coupling susceptances become very low and in practice, physical embodiments become very difficult if not impossible.

An article entitled "Broadband Millimeter Wave E-plane Bandpass Filters in IEEE MTT-S Digest (1984, pp 236–237) describes a method of designing an E-plane bandpass filter having pass bands which are greater than 10% and in which the structure used is a so-called "ladder" structure.

SUMMARY OF THE INVENTION

To this end, the invention provides an E-plane type wideband composite filter comprising a conductive screening body having an elongate cavity therein with an E-plane filter structure disposed longitudinally therein, said structure being in the form of a blade having a plurality of rectangular openings cut therethrough, the composite filter being characterized in that said body comprises two portions held against each other on either side of a separation plane along which said structure is disposed, and in that two irises are disposed transversely at the inlet and at the outlet of said cavity beyond the ends of said E-plane filter structure.

Such a filter has the advantage of making it possible to obtain wider pass bands while retaining good transfer function characteristics.

Advantageously, a filter in accordance with the invention comprises an add-on structure received between two longitudinal notches machined in at least one of the two portions of the screening body, with the E-plane structure being a metal structure. Each of the two irises comprises a blade having at least one rectangular opening therethrough with one of its sides being parallel to the intersection between the separation plane and the plane of the iris, each iris being received in two transverse notches machined in the two portions of the screening body.

BRIEF DESCRIPTION OF THE DRAWINGS

The characteristics and advantages of the invention also appear from the following description given by way of non-limiting example and with reference to the accompanying figures, in which.

MORE DETAILED DESCRIPTION

Figure 1:
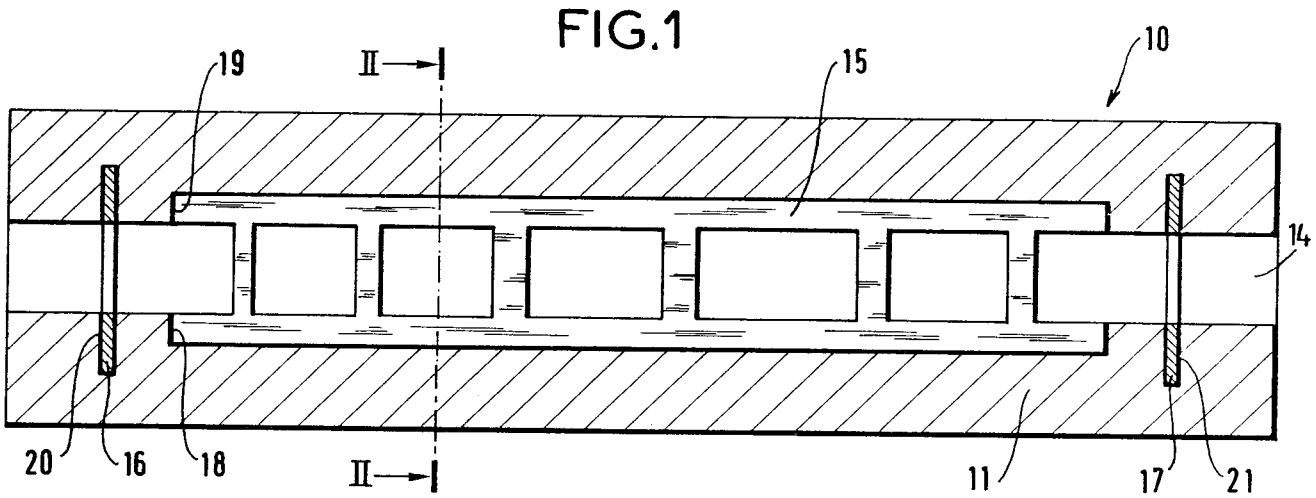
FIGS. 1 and 2 show a filter in accordance with the invention respectively in a longitudinal section view in plane I—I of FIG. 2 and in a cross-section view in plane II—II of FIG. 1.
Figure 2:
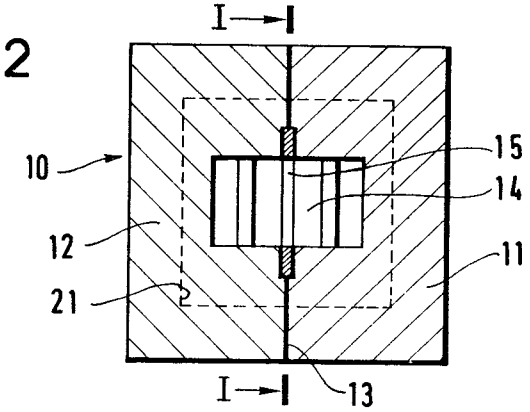

In a manner known to the person skilled in the art, waveguide filters having inductively coupled cavities are obtained by putting resonant cavities in cascade with each cavity being tuned, for example by a screw, said cavities being coupled to one another via irises or via curtains of rods.

The equivalent circuit of such a filter consists in susceptances separated by transmission lines.

An E-plane filter is in the form of a "ladder" inserted in a waveguide along its propagation axis. The ladder which constitutes the essential component of the filter may be made entirely of metal, being of the type comprising a uni- or bi-lateral line of fins.

The equivalent circuit of this type of filter may be represented by a succession of symmetrical T circuits: each symmetrical T circuit having an influence equivalent to the influence of the "strips" or transverse blades constituting the ladder. The Ts associated with the transmission lines operate as admittance inverters, thereby providing a filter function.

The reactances $X_{si}$, $X_{si}$ and $X_{pi}$ of the branches of the T may be calculated using the work of Yi-Chi Shih (IEEE vol. MTT-32 No. 7 July, 1984).

In transmission systems, antenna filters must have insertion losses which are as small as possible. With the appearance of wideband applications, it is necessary to use appropriate filters.

E-plane filters may be made for band widths exceeding 10% over a frequency range running from X-band (8 GHz to 12 GHz) to D-band (110 GHz to 175 GHz) with a Q factor $>1000$.

However, the relative pass band of these filters is limited. As the pass band increases, the end reactances ($X_{pi}$ and $X_{pn}$) to be made also increase. The same applies if the in-band undulations of the response are to be reduced. Thus, the widths $W_1$ and $W_n$ of the end "strips" become impossible to make in practice. Even increasing the number n of poles does not bring any improvement beyond $n=7$.

Further, because of the thickness of the ladder, the pass band is shifted to higher frequencies and its width is decreased. The calculated relative pass band is thus greater than that which is obtained in practice. This contributes to further reducing $W_1$ and $W_n$.

The influence of thickness cannot be indefinitely reduced, since the structure would then become mechanically fragile.

In order to mitigate these drawbacks, the filter 10 in accordance with the invention comprises a conductive screening body (11, 12) comprising two portions 11 and 12 which are held together against each other on either side of a separation plane 13.

Inside this body (11, 12) there is a cavity 14 which is in the form of a rectangular parallelipiped split by the plane 13 into two same-shape volumes. This cavity contains an E-plane filter structure 15 in the form of a blade having a plurality of rectangular openings cut out therethrough with one of its faces being situated, for example, in the separation plane 13. This blade 15 may be ladder-shaped, for example.

Two irises 16 and 17 are situated at the inlet and at the outlet to and from the cavity 14 so that each of them closes a portion thereof.

The structure 15 is an add-on structure received in two longitudinal notches 18 and 19 which are machined, for example, in the two portions 11 and 12 on either side of the cavity 13.

Figure 3:
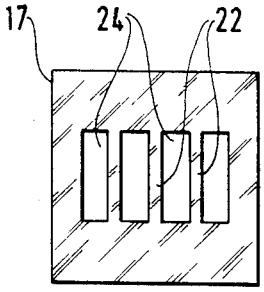
FIGS. 3 to 7 show different possible embodiments for the inlet and outlet irises.
Figure 4:
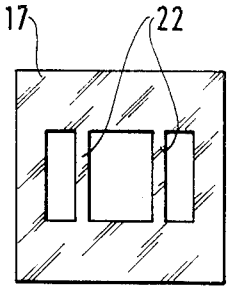
Figure 5:
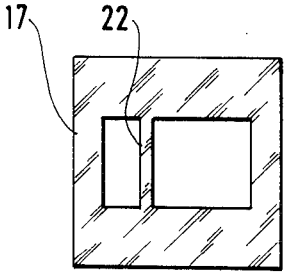
Figure 6:
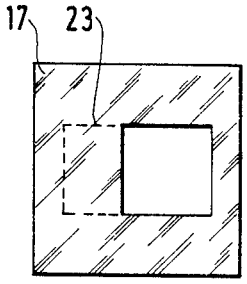

The irises 16 and 17 are in the form of blades having vertical rectangular openings 24 therethrough as shown, for example in FIG. 3, and they are received in two transverse notches 20 and 21 machined in the two portions 11 and 12 and situated at the two ends of the cavity 14.

Thus, by integrating the inlet irises with the two ends of the cavity 14 the difficulties of making inlet susceptancies are overcome by making a composite filter.

These irises, as shown in FIGS. 3, 4, 5, 6, and 7 may be constituted, for example, by one, two, or three rods 22 or by one or two inductive flaps 23. These items may be disposed symmetrically or otherwise about the propagation axis.

Figure 7:
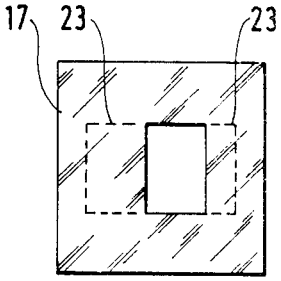

An example is obtained using the following values:

7-pole Chebyshev filter;
minimum frequency 27.5 GHz
maximum frequency 30 GHz;
cavity height 3.56 mm
cavity width 7.12 mm;
length of the ladder which has 6 strips 46.54 mm;
thickness of the metal in which the ladder is etched 0.1 mm; and
width of the iris aperture as shown in FIG. 7 about 3.56 mm.

Naturally the present invention has been described and shown solely by way of preferred example and its component items could be replaced by equivalent items without thereby going beyond the scope of the invention.

Thus, the structure of the E-plane filter and also of the two irises could form an integral portion of one or the other of the two portions of the screening body, and they would then not be add-on parts.

The irises may be respectively made simply by a break in the dimensions of the waveguide.

We claim:

1. An E-plane type wideband composite filter comprising a conductive screening body having an elongate cavity therein with an E-plane filter structure disposed longitudinally therein, said structure being in the form of a blade having a plurality of rectangular openings cut therethrough, said body comprising two portions held against each other on either side of a separation plane along which said structure is disposed, and two irises being disposed transversely at the inlet and at the outlet of said cavity beyond the ends of said E-plane filter structure and wherein the irises are received in two transverse notches machined in the two portions of the screening body, thereby overcoming the inlet susceptances in forming said composite filter while obtaining wider inlet pass bands and retaining good transfer function characteristics.

2. A filter according to claim 1, wherein the E-plane filter structure is a blade in the form of a ladder.

3. A filter according to claim 1, wherein the cavity is in the form of a rectangular parallelepiped with the separation plane splitting it into two same-shape volumes, and wherein the E-plane structure is an add-on structure received in two longitudinal notches machined in at least one of the two portions of the screening body.

4. A filter according to claim 1, wherein the E-plane structure is a metal structure.

5. A filter according to claim 1, wherein each iris comprises a blade having at least one rectangular opening therethrough with one of its sides being parallel to the intersection of the plane of separation and the plane of the corresponding iris.

6. A filter according to claim 1, wherein each iris includes openings disposed symmetrically within the cavity.

7. A filter according to claim 1, wherein the irises are disposed symmetrically about the filter propagation axis.

* * * * *